United States Patent [19]

Lauener

[11] 4,341,259

[45] Jul. 27, 1982

[54] METHOD FOR SPEED CONTROL OF A CONTINUOUS METAL STRIP CASTING MACHINE AND ROLLING MILL ARRANGEMENT, AND SYSTEM CONTROLLED ACCORDING TO THIS METHOD

[75] Inventor: Wilhelm F. Lauener, Recherswil, Switzerland

[73] Assignee: W. F. Lauener AG, Thun, Switzerland

[21] Appl. No.: 104,794

[22] Filed: Dec. 18, 1979

[30] Foreign Application Priority Data

Dec. 29, 1978 [CH] Switzerland ..... 13268/78

[51] Int. Cl.[3] ..... B22D 11/16

[52] U.S. Cl. ..... 164/454; 164/476; 164/413; 164/455; 164/414; 164/417

[58] Field of Search ..... 164/4, 413, 414, 154, 164/155, 427–434, 76, 270, 150; 72/17, 19

[56] References Cited

U.S. PATENT DOCUMENTS

| | | | |
|---|---|---|---|
| 3,101,016 | 8/1963 | Gill | 72/17 |
| 3,358,743 | 12/1967 | Adams | 164/413 X |
| 3,510,057 | 5/1970 | Werme | 164/414 X |
| 3,726,333 | 4/1973 | Goodrich et al. | 164/413 X |
| 3,864,973 | 2/1975 | Petry | 164/150 X |

FOREIGN PATENT DOCUMENTS

| | | | |
|---|---|---|---|
| 2110639 | 9/1971 | Fed. Rep. of Germany | 72/19 |
| 2129082 | 12/1971 | Fed. Rep. of Germany | 72/19 |
| 1783132 | 3/1972 | Fed. Rep. of Germany . | |
| 2850241 | 5/1979 | Fed. Rep. of Germany | 164/413 |
| 2285947 | 4/1976 | France . | |
| 2384560 | 10/1978 | France . | |

OTHER PUBLICATIONS

"Handbuch des Stranggiessens" by Herrmann, pp. 536–537, and 540–541.

"Continuous Costing Between Moving Flexible Belts", Sheet Metal Ind., vol. 54, No. 3 (Britain: Mar., 1977).

"Schweizer Maschinehmarkt" No. 18 (1974), pp. 42–43.

*Primary Examiner*—Gus T. Hampilos

*Assistant Examiner*—K. Y. Lin

*Attorney, Agent, or Firm*—Wender, Murase & White

[57] ABSTRACT

A method for controlling a casting and rolling mill by measuring the speed of a cast strip between the casting machine and the first following rolling mill and regulating the speed of the casting machine directly proportional to the measured speed of the cast strip. It is thus possible to avoid auxiliary equipment required in prior art systems such as pinch rolls and a continuous furnace between the casting machine and the first following rolling mill. Furthermore no loop on the cast strip is required. As a result, great reductions in capital expenditures, the energy required to operate the line and the necessary space can be obtained.

8 Claims, 1 Drawing Figure

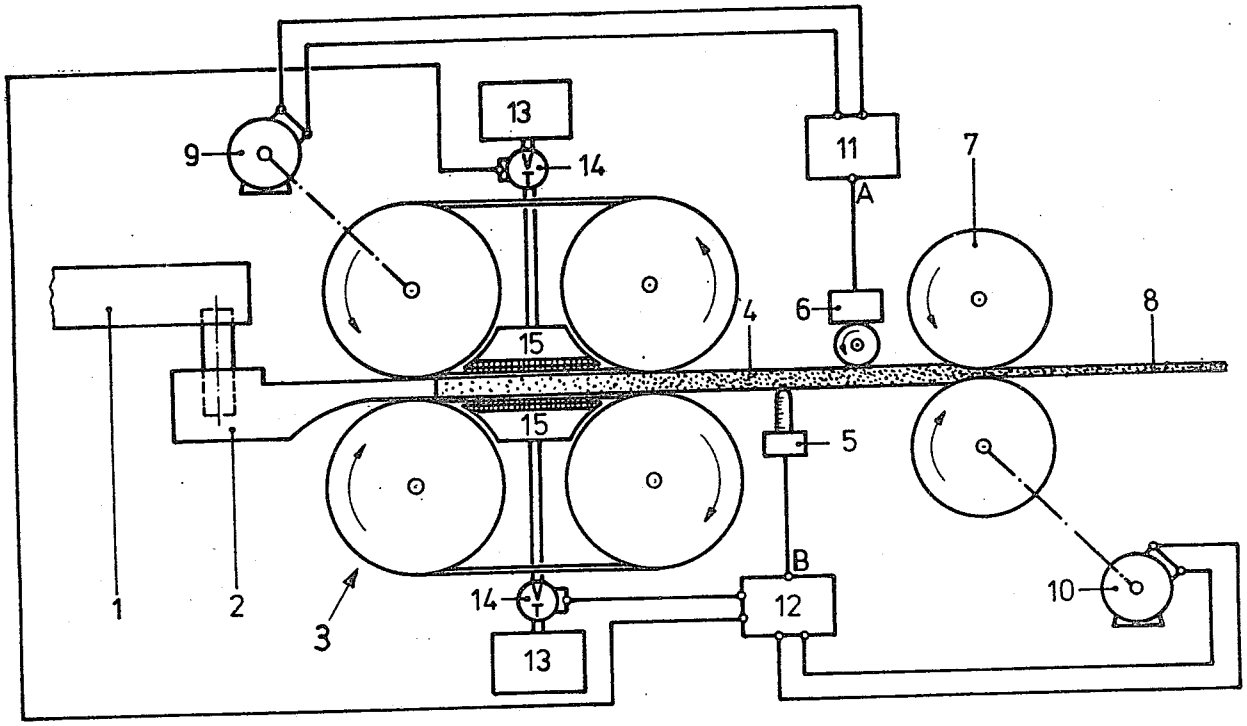
1
2
3
4
5
6
7
8
9
10
11
12
13
14
15
A
B

METHOD FOR SPEED CONTROL OF A CONTINUOUS METAL STRIP CASTING MACHINE AND ROLLING MILL ARRANGEMENT, AND SYSTEM CONTROLLED ACCORDING TO THIS METHOD

BACKGROUND OF THE INVENTION

For the production of metal strips, it is possible to utilize continuous working casting machines featuring moving molds (Dr. Herrmann, "Handbuch des Stranggiessens").

Practical application has shown that the speed of the moving molds must be very precisely synchronized with the speed of the strip being cast, in order to avoid relative motion between the originating strip and the surfaces of the moving molds and thereby prevent the occurrence of tension cracks within the solidifying material.

The term mold can apply to any element adapted to form a casting chamber such as revolving metal belts, successive blocks formed of one piece or of a plurality of assembled elements, as well as casting wheels.

In order to create optimal conditions during the casting process, it is therefore necessary that the speed of the molds as well as the speed of the strip being cast be continuously adjustable.

If the casting machine produces a strip having a thickness greater than the dimension which is permissible for the cooling or for coiling off of that strip, it is necessary to roll the cast strip in line and in synchronism with the casting machine.

It is known that the speed of the strip engaged in the rolling process is dependent upon various factors. The practice has shown that even for a given decrease of the thickness and a constant angular velocity of the rolls, the speed of the strip may still experience variations as a function of time.

While it is possible to maintain a practically constant rate of deformation of the strip, practice has shown that it is not possible to maintain a constant value for the coefficient of friction which is dependent upon various factors, nor for the strength or the strain resistance. Both latter values depend for example from the temperature of the strip being rolled, from the rolling speed and from other factors.

Under such conditions, the speed of the strip being rolled may fluctuate several percentages in value over periods of time, even when the peripheral speed or the angular velocity of the rolls remains constant.

For that reason a rigid coupling between the casting machine and the rolling mill is not possible with respect to their individual speed.

At the present it is customary to place pinch rolls at the outlet of the casting machine and to allow for a loop in the cast strip in order to compensate for the speed differences of the strip between the casting machine and the rolling mill. It is also possible to utilize the variations of that loop to produce a signal for controlling the drive of the rolling mill (lecture by R. W. Hazelett and Dr. C. E. Schwartz, American Institute of Mining, 1964, or "Bänder, Bleche, Rohre", Issue no 9, 1970, pages 469–471).

The pinch rolls consist of one or several driven pairs of rolls arranged one behind the other in series, which seize the cast strip emerging from the casting machine and guide it under relatively light rolling pressure and at a speed precisely adapted to that of the casting machine, thus eliminating the influence of any forces on the casting machine which act from the outside on the strip, in the direction of casting.

The auxiliary equipment described above requires a relatively great distance between the casting machine and the first rolling mill. This causes a cooling of the cast strip due to radiation of heat and contact with guide rolls. In order to obtain the required temperature for rolling it is usually necessary to place a continuous furnace ahead of the rolling mill to compensate for the heat loss.

Such additional equipment represents a large part of the capital expenditure involved in a casting and rolling plant. Moreover, using the continuous furnace raises the operating expenses besides being in direct contradiction with the general present trend to save energy.

In order to obtain the required precision of regulation of the driving speed of the cast strip to accommodate different equipment arranged in series in the system, the driving speed of the casting machine or the one of the pinch rolls according to the present invention is measured and used as a rated value for controlling the speed of the other elements in the line. For this purpose, there exist already many suitable control devices on the market.

SUMMARY OF THE INVENTION

The object of the present invention is a method for effecting speed control of a casting machine and if need be of a rolling mill, wherein auxiliary equipment like pinch rolls, guide rolls for a strip loop and a continuous furnace may be completely avoided, thus achieving considerable savings in capital expenditures and operating expenses.

The method according to the present invention comprises determining the speed of the solidified strip between the casting machine and the first following rolling mill and utilizing said measured speed as a rated value for controlling the drive of the casting machine.

In this manner, the speed of the molds is continuously and directly adjusted to the speed of the originating cast strip, thus permitting operation of the casting and rolling plant without any strip loop in the system. If necessary, the cast strip can be guided without any strain over supporting rolls located between the casting machine and the first rolling mill.

Various measuring and control devices offering sufficient precision are presently known which may be utilized for determining the speed of the cast strip and transmission of the corresponding signal.

One method comprises obtaining electronically by well known means, a control signal that corresponds to the number of revolutions of a measuring roll which is in contact with the cast strip. It is also possible to utilize measuring and control devices which do not involve physical contact with the cast strip and are already existing on the market (see "Schweizer Maschinenmarkt, No. 18/1974, pages 42, 43).

The speed of the cast strip is preferably measured at the outlet of the casting machine and utilized as a rated value for controlling the drive of the casting machine.

The invention will be described further by way of example, with reference to the accompanying drawing.

DESCRIPTION OF THE DRAWING

The unique FIGURE represents the arrangement of a continuous strip casting machine with a subsequent rolling mill.

DESCRIPTION OF THE PREFERRED EMBODIMENT

The FIGURE shows a casting machine 3 associated with a trough 1 and a tundish 2 to deliver molten metal into the casting machine. The cast strip 4 exits the casting machine and is engaged by a first rolling mill 7 which delivers a rolled strip 8 of reduced thickness. The casting machine is driven by a first motor 9 and the rolling mill by a second motor 10.

For the reason set forth above, it is necessary to control the speed of the casting machine 3 as well as the speed of the cast strip 4. Accordingly a speed measuring device 6 is utilized in controlling the speed of the casting machine 3 on the basis of the cast strip's speed between casting machine 3 and subsequent rolling mill 7. Said speed of the cast strip 4 is influenced by the rolling mill 7.

It is possible to measure the temperature of the cast strip 4 at the outlet of the casting machine 3 by means of a temperature measuring device 5 and to utilize this measurement for controlling the speed of the rolling mill 7 which in turn influences the speed of the cast strip 4 and thus the signal produced by the speed measuring device 6 which ultimately controls the speed of the casting machine.

It has been said above that various existing measuring and control devices offering sufficient precision may be utilized for controlling the speed of the casting machine as well as that of the rolling mill. Such devices are represented in the FIGURE by the boxes 11 and 12 which receive at their inputs A and B, respectively, signals produced by the speed indicative of device 6 measuring the speed of the cast strip between the casting machine and the following first rolling mill, and signals produced by the temperature indicative of device 5 measuring the temperature of the cast strip at the outlet or in the neighbourhood of the casting machine. The speed measuring device 6 of the FIGURE has been represented as a measuring roll in contact with the cast strip but any other speed measuring apparatus, including any noncontacting speed measuring apparatus, may be utilized. As shown in the FIGURE, the device 11 controls the motor 9 of the casting machine. The FIGURE also shows part of the cooling system 13 of the casting machine for controlling the temperature of the cast strip by means of a continuously adjustable valve 14 and a cooler 15 delivering cooling water to the cast strip. Valve 14 may be controlled by the control device 12 in order to adjust the intensity of cooling to the measured temperature. Control device 12 is also connected to the motor 10 driving the rolling mill 7 so as to effect control of the speed of the rolling mill in response to the temperature measured by the measuring device 5.

The following possibilities may be envisaged:

1. The drive of the rolling mill is not controlled automatically

From the preceding, and for the reasons indicated above, the speed of the cast strip is known to vary as a function of time. In this first case therefore, the speed of the casting machine is controlled in direct response to the measured speed of the cast strip as influenced by the rolling mill with the measured speed of the cast strip being used as a rated value for controlling and optimizing the speed of the casting machine. The speed of the casting machine is thereby synchronized to the speed of the rolling mill.

2. The speed of the casted strip is controlled by special measurements

In this second case, the temperature of the cast strip as measured by the temperature measuring device 5 between the casting machine and the following rolling mill can be utilized for the supervision of the casting process and for the subsequent treatment of the cast strip in the production line. The value of this measured temperature is influenced by the casting speed and/or the intensity of the cooling, either of which can be regulated.

The temperature of the cast strip 4 must be maintained within narrow limits, in order to achieve the optimal conditions for operating the casting line. The temperature is preferably measured directly at the outlet of the casting machine.

Based on this measurement the speed of the cast strip is adjusted to constantly maintain the most favorable temperature of the strip. This may be achieved in two ways:

(a) The number of revolutions of the rolls of the rolling mill 7 is controlled by the temperature measuring device 5 coupled to the motor 10 through control device 12 so that the number of revolutions increases when the temperature is too low and decreases when the temperature is too high.

(b) The intensity of the cooling is regulated by way of a valve 14 connected to control devide 12 so that the optimal temperature of the cast strip is continually maintained with the temperature of the cast strip serving as a rated value for controlling the valve.

3. A determined, constant speed of the strip is required

The drive of the rolling mill 7 is controlled by the speed of the strip, so that this speed is maintained practically constant. With the control apparatus, the required speed of the casting machine is also regulated and maintained constant.

The principle of speed control of the drive of a continuous strip casting line (CSC-line) according to the present invention requires a minimum of capital expenditure and maintenance expenses. Moreover, elimination of the mechanical equipment required in prior art systems (pinch rolls, strip loop and continuous furnace are no more required) leads to a further significant reduction of the costs.

An additional advantage is a reduction in the amount of space required for a production line which again favorably influences the capital expenditures.

What I claim is:

1. A method for control of a casting and rolling plant including a casting machine having a molding assembly with continuously advancing molding surface for producing a cast strip, means for driving the molding assembly, a rolling mill for rolling the cast strip and means for driving the rolling mill, said method comprising the steps of:

positioning the rolling mill relative the casting machine such that the speed of the cast strip as it exits the casting machine and is fed to the rolling mill is directly affected by the speed of said rolling mill;

measuring the speed of said cast strip between said casting machine and said rolling mill; and controlling the speed of the means for driving the molding assembly in direct proportion to said measured speed whereby the speed of said casting machine is synchronized with and follows the speed of said rolling mill.

2. A method as recited in claim 1 further comprising the steps of measuring the temperature of the cast strip leaving the casting machine, and controlling the speed of said means for driving the rolling mill in response to said measured temperature so as to cause the speed of the rolling mill and the synchronized casting machine to increase when said measured temperature is below a predetermined value and to decrease when said measured temperature is above said predetermined value.

3. A method as recited in claim 1 wherein the casting machine includes means for cooling the molding assembly, said method further comprising the steps of measuring the temperature of the cast strip leaving the casting machine, and controlling said means for cooling the molding assembly in response to said measured temperature whereby the effect of the cooling means is intensified as said measured temperature increases so that the strip is maintained at a predetermined temperature.

4. A method as recited in claim 1 wherein the speed of the strip is measured at a point immediately following the casting machine.

5. A casting and rolling plant for producing a cast strip, comprising:

a continuous casting machine including a molding assembly with continuously advancing molding surface for producing the cast strip and means for driving said molding assembly;

a rolling mill for rolling the cast strip and means for driving said rolling mill, said rolling mill positioned relative said casting machine such that the speed of the cast strip as it exits said casting machine and is fed to said rolling mill is directly affected by the speed of said rolling mill;

means for measuring the speed of the cast strip between said casting machine and said rolling mill; and means for controlling the speed of said means for driving said molding assembly in direct proportion to said measured speed whereby the speed of said casting machine is synchronized with and follows the speed of said rolling mill.

6. A casting and rolling plant as recited in claim 5 further comprising means for measuring the temperature of the cast strip leaving said casting machine, and means for controlling the speed of said means for driving said rolling mill in response to said measured temperature so as to cause the speed of said rolling mill and said synchronized casting machine to increase when said measured temperature is below a predetermined value and to decrease when said measured temperature is above a predetermined value.

7. A casting and rolling plant as recited in claim 5 wherein said casting machine includes means for cooling the molding assembly, and the plant further comprises means for measuring the temperature of the cast strip leaving said casting machine and means for controlling said means for cooling the molding assembly in response to said measured temperature whereby the effect of said cooling means is intensified as said measured temperature increases so that the strip is maintained at a predetermined temperature.

8. A casting and rolling plant as recited in claim 5 wherein said means for measuring the speed of the cast strip is positioned so as to measure said speed of the strip at a point immediately following said casting machine.

* * * * *